US010618696B2

(12) United States Patent
Ohyama et al.

(10) Patent No.: US 10,618,696 B2
(45) Date of Patent: Apr. 14, 2020

(54) PACKAGING BAG AND METHOD FOR MANUFACTURING PACKAGING BAG

(71) Applicant: HOSOKAWA YOKO CO., LTD., Tokyo (JP)

(72) Inventors: Akira Ohyama, Tokyo (JP); Hiroyuki Arai, Tokyo (JP); Akio Youtou, Tokyo (JP)

(73) Assignee: HOSOKAWA YOKO CO., LTD. (JP)

( * ) Notice: Subject to any disclaimer, the term of this patent is extended or adjusted under 35 U.S.C. 154(b) by 565 days.

(21) Appl. No.: 15/297,950

(22) Filed: Oct. 19, 2016

(65) Prior Publication Data

US 2017/0113843 A1 Apr. 27, 2017

(30) Foreign Application Priority Data

Oct. 23, 2015 (JP) ..... 2015-208957

(51) Int. Cl.
*B65D 75/58* (2006.01)
*B65D 75/62* (2006.01)
(Continued)

(52) U.S. Cl.
CPC ..... *B65D 33/2508* (2013.01); *B31B 70/14* (2017.08); *B31B 70/81* (2017.08); *B65D 65/40* (2013.01); *B65D 75/58* (2013.01); *B65D 75/5805* (2013.01); *B65D 75/5827* (2013.01); *B31B 70/16* (2017.08);
(Continued)

(58) Field of Classification Search
CPC ..... B65D 75/58; B65D 75/5808; B65D 75/5811; B65D 75/5827; B65D 75/5833; B65D 75/5844; B65D 33/007; B65D 33/25–2591
USPC ..... 383/200, 203, 204, 207–209, 35, 61.1, 383/63–65
See application file for complete search history.

(56) References Cited

U.S. PATENT DOCUMENTS 6,964,520 B1 * 11/2005 Sakai ..... B65D 33/2533 383/116
2006/0177162 A1 * 8/2006 Harano ..... B65D 75/5816 383/202

FOREIGN PATENT DOCUMENTS

JP 2009-118343 A 6/1997
JP 2001-151246 A 6/2001
(Continued)

OTHER PUBLICATIONS

JP2014218278Translation (Year: 2014).*
(Continued)

*Primary Examiner* — Jes F Pascua
*Assistant Examiner* — Nina K Attel
(74) *Attorney, Agent, or Firm* — Hovey Williams LLP

(57) ABSTRACT

A packaging bag is formed in a bag shape by overlapping of a laminated film and a laminated film facing each other, and unsealed by cutting of a predetermined section. The packaging bag includes a zipper for opening and closing an opening, the zipper being provided along edges of the opening formed by the unsealing, a linear cut section that is formed in a functional layer of the laminated film so as to be parallel to the zipper, and becomes the edge of the opening by the unsealing of the packaging bag, and a linear cut section that is formed at a different level from the cut section in a functional layer of the laminated film so as to be parallel to the zipper, and becomes the edge of the opening by the unsealing of the packaging bag.

10 Claims, 12 Drawing Sheets

(51) Int. Cl.

| | |
|---|---|
| ***B65D 33/25*** | (2006.01) |
| ***B65D 65/40*** | (2006.01) |
| ***B31B 70/81*** | (2017.01) |
| ***B31B 70/14*** | (2017.01) |
| *B31B 155/00* | (2017.01) |
| *B31B 160/10* | (2017.01) |
| *B31B 70/16* | (2017.01) |

(52) U.S. Cl.
CPC ..... *B31B 70/8131* (2017.08); *B31B 2155/002* (2017.08); *B31B 2160/10* (2017.08); *B65D 2575/586* (2013.01)

(56) References Cited

FOREIGN PATENT DOCUMENTS

| | | | | |
|---|---|---|---|---|
| JP | 2001151246 | A | * | 6/2001 |
| JP | 2014-055016 | A | | 3/2004 |
| JP | 2005-029196 | A | | 2/2005 |
| JP | 2007-106497 | A | | 4/2007 |
| JP | 2009-227319 | A | | 10/2009 |
| JP | 2011-246174 | A | | 12/2011 |
| JP | 2012-096839 | A | | 5/2012 |
| JP | 2014-039652 | A | | 3/2014 |
| JP | 2014218278 | A | * | 11/2014 |

OTHER PUBLICATIONS

JP2001151246Translation (Year: 2001).*
Japanese Office Action dated May 15, 2019 received in connection with Japanese Patent Application No. 2015-208957, 8 pages.

* cited by examiner

PACKAGING BAG AND METHOD FOR MANUFACTURING PACKAGING BAG

CROSS-REFERENCE TO RELATED APPLICATIONS

The present U.S. non-provisional patent application claims priority benefit to Japanese Patent Application No. 2015-208957, filed on Oct. 23, 2015, the entirety of which is herein incorporated by reference.

TECHNICAL FIELD

The present invention relates to a packaging bag, and a method for manufacturing a packaging bag.

BACKGROUND ART

As packaging bags, there is, for example, a packaging bag in which while a user grips the upper side of a packaging bag by one of his/her hands, the lower side of the packaging bag is gripped by the other hand, and the both hands are relatively moved in the different directions in the above state, so the upper side of the packaging bag is cut to be unsealed.

Then, among the packaging bags, there is a so-called reclosable packaging bag in which a reclosable means such as a zipper is previously provided near an opening formed by unsealing, and opening and closing of the packaging bag is possible by resealing by use of this zipper after unsealing.

In such a reclosable packaging bag, when an edge of a front surface film and an edge of a back surface film that face at the opening coincide with each other, it is not easy to hold only one film by tips of person's fingers. As a result, it is difficult to widen the opening, grasp the position of the zipper, and perform opening and closing by the zipper.

PTL 1 discloses a reclosable packaging bag in which the widths of pedestal sections of a pair of zipper pieces are different, the pedestal sections are fixed to a packaging bag body while non-sealed sections remain on opening side edges, positions of opening edges of a front surface and a back surface of the packaging bag body in unsealing are different, an opening is found, and opening and closing of zipper sections of the pair of zipper pieces easily performed. Consequently, in the reclosable packaging bag disclosed in PTL 1, a level difference is generated between the edge of the front surface film and the edge of the back surface film.

The reclosable packaging bag disclosed in PTL 1 is provided with an indication mark indicating the cut direction in unsealing near a notch.

Additionally, PTL 2 discloses a packaging bag in which a curved cut line and a linear cut line are formed in an outer layer, and the packaging bag is integrally torn along the curved cut line and the linear cut line to be unsealed, and tearing and unsealing lines are a smooth curved line and a linear line. On an inner surface of this packaging bag, a meshing tool (zipper) is provided on the lower end sides of the cut lines.

Furthermore, PTL 3 discloses a packaging bag in which a slit extending in the transverse direction in one surface of the packaging bag is provided, a slit provided on the other surface so as to deviate on the opening end side with respect to the slit provided on the one surface, and extending in the transverse direction is provided, so that a level difference can be generated between opening ends of the both surfaces in unsealing along the slits.

CITATION LIST

Patent Literature

PTL 1—Japanese Unexamined Patent Application, Publication No. H9-118343;

PTL 2—Japanese Unexamined Patent Application, Publication No. 2012-96839; and

PTL 3—Japanese Unexamined Patent Application, Publication No. 2005-29196.

SUMMARY OF INVENTION

Technical Problem

However, depending on, for example, the direction of force applied when the reclosable packaging bag disclosed in PTL 1 is unsealed, an upper section of the packaging bag sometimes cannot be linearly (horizontally) cut off. The above indication mark indicating the cut direction is an indication printed on the reclosable packaging bag, and the cut direction is not determined by this indication mark.

When the upper section of the reclosable packaging bag is not linearly cut off to be unsealed, there is a possibility that the edge of the opening of the packaging bag is not formed linearly with respect to the zipper, and the above level difference is not also formed. As a result, this becomes a factor that causes impairing of convenience of the unsealed reclosable packaging bag, for example, it becomes difficult for a user to recognize the position of the zipper, or it becomes inconvenient to take out and in a content.

Additionally, in the packaging bag disclosed in PTL 2, while the meshing tool (zipper) is provided, an unsealing line formed when the packaging bag is unsealed is a curved line, and therefore the edge of the opening of the packaging bag is not formed linearly with respect to the zipper. In a case where the unsealing line is the curved line, a possibility that the opening is torn while deviating from the unsealing line becomes high.

Furthermore, in the packaging bag disclosed in PTL 3, no zipper is provided, and therefore a positional relation between the edge of the opening of the packaging bag and the zipper is not disclosed.

The present invention has been made in view of the aforementioned circumstances, and an object of the invention is to provide a packaging bag capable of forming a linear level difference between edges of an opening so as to be parallel to a zipper, and a method for manufacturing a packaging bag.

Solution to Problem

In order to solve the above problem, a packaging bag and a method for manufacturing a packaging bag of the present invention employ the following solutions.

A packaging bag according to a first aspect of the present invention is a packaging bag formed in a bag shape by overlapping of a first laminated film and a second laminated film facing each other, and unsealed by cutting of a predetermined section, and include: a zipper for opening and closing an opening, the zipper being provided along edges of the opening formed by the unsealing; a linear first cut section that is formed in an intermediate layer or an outer layer of the first laminated film so as to be parallel to the zipper, and becomes the edge of the opening by the unsealing; and a linear second cut section that is formed at a different level from the first cut section in an intermediate layer or an outer layer of the second laminated film so as to be parallel to the zipper, and becomes the edge of the opening by the unsealing.

A packaging bag according to this configuration is formed by the first laminated film and the second laminated film facing each other, and is unsealed by cutting of the predetermined section. The zipper for opening and closing the opening formed by the unsealing is provided in the edges of the opening, and this zipper enables the opening and closing of the opening.

In view of the convenience of the packaging bag, the edges of the opening formed by the unsealing are at different levels on a front surface and a back surface, and are linearly (horizontally) formed.

In this configuration, the linear first cut section that becomes the edge of the opening by the unsealing is formed in the intermediate layer or the outer layer of the first laminated film so as to be parallel to the zipper, and the linear second cut section that becomes the edge of the opening by the unsealing is formed at the different level from the first cut section in the intermediate layer or the outer layer of the second laminated film so as to be parallel to the zipper.

The first cut section and the second cut section are previously formed in the intermediate layer or the outer layer, so that the packaging bag is cut along the first cut section and the second cut section, that is, so as to be parallel to the zipper. Additionally, the first cut section and the second cut section are formed at the different levels. Therefore, a user of the packaging bag can easily open the opening, and can easily confirm the position of the zipper, and therefore opening and closing by the zipper is facilitated.

Thus, in this configuration, the first cut section and the second cut section are previously linearly formed in the intermediate layer or the outer layer at the different levels so as to be parallel to the zipper, and therefore a linear level difference can be formed between the edges of the opening so as to be parallel to the zipper.

In the above first aspect, the first cut section and the second cut section may be continuous cuts.

According to this configuration, the first cut section and the second cut section are continuous cuts, and therefore it is possible to more reliably form the linear edges of the opening.

In the above first aspect, the first cut section may include a plurality of cuts formed spaced apart from each other so as to be parallel to the zipper, and the second cut section may be formed at a center of a region where the first cut section is projected in the second laminated film.

When the packaging bag is unsealed, depending on a dominant hand of a user, or difference between a pulling tearing and pushing tearing, the unsealing starting position is determined on the left or the right of the packaging bag, and the direction of applied force is different.

In this configuration, the first cut section in accordance with the direction of force applied in unsealing, among the first cut section formed at a plurality of portions, and the second cut section formed at the center of the region where the first cut section is projected in the second laminated film can form a linear level difference between the edges of the opening. Therefore, according to this configuration, the linear level difference can be formed between the edges of the opening so as to be parallel to the zipper regardless of the direction of force applied when the packaging bag is unsealed.

In the above first aspect, a plurality of the first cut sections and a plurality of the second cut sections may be each formed spaced apart from each other so as to be parallel to the zipper, a third cut section may be formed in the outer layer of the first laminated film so as to overlap with the first cut section, and a fourth cut section may be formed in the outer layer of the second laminated film so as to overlap with the second cut section.

In this configuration, the packaging bag is unsealed by the third cut section and the fourth cut section formed in the outer layers. However, in a case where the strength of the intermediate layers or the outer layers is high, there is a possibility that the intermediate layers or the outer layers become resistance to cutting, and the force applying direction is changed. Therefore, in order to more reliably linearly cut the intermediate layers or the outer layers, a plurality of the first cut sections and a plurality of the second cut sections are formed.

According to this configuration, the packaging bag is cut by the first cut section and the second cut section cut section in accordance with the force applying direction. Therefore, even when the laminated films are each formed by three or more layers, a linear level difference can be more reliably formed between the edges of the opening so as to be parallel to the zipper.

In the above first aspect, the third cut section may include a plurality of cuts formed spaced apart from each other so as to be parallel to the zipper, and the fourth cut section may be formed at a center of a region where the third cut section is projected in the second laminated film.

In this configuration, the third cut section in accordance with the direction of force applied in unsealing, among the third cut section formed at a plurality of portions, and the fourth cut section formed at the center of the region where the third cut section is projected in the second laminated film form a linear level difference between the edges of the opening. Therefore, according to this configuration, the linear level difference can be formed between the edges of the opening so as to be parallel to the zipper regardless of the direction of force applied when the packaging bag is unsealed.

In the above first aspect, the packaging bag may include a notch that serves as a starting position of the unsealing, wherein the notch may be formed by one end of a curved shape and one end of a V-shape continued to the one end of the curved shape, and the first cut section or the second cut section may be provided in a tip direction of the V-shape.

In this configuration, when a user of the packaging bag applies force to a portion where the notch is formed, the force is not concentrated on the curved shape, but concentrated on the tip direction of the V-shape. Therefore, regardless of the direction of the force applied to the notch, the force is concentrated on the tip direction of the V-shape, and the packaging bag is cut along the tip direction. That is, with the notch formed by the one end of the curved shape and the one end of the V-shape continued to the one end of the curved shape, the directivity of cutting is imparted. In this configuration, the first cut section or the second cut section is provided in the tip direction of the V-shape, so that the packaging bag can be unsealed along the first cut section and the second cut section regardless of the direction of the force applied to the notch.

In the above first aspect, the packaging bag may include a notch that serves as a starting position of the unsealing; and a guide section for guiding a direction of cutting by the notch to the first cut section or the second cut section.

According to this configuration, cutting with the notch as the starting position is performed along the guide section, and the direction of the cutting by the notch is guided to the first cut section or the second cut section, and therefore the packaging bag can be unsealed along the first cut section and the second cut section regardless of the direction of force applied to the notch.

In the above first aspect, edges of a pair of pedestal sections of the zipper may be at different levels in a direction of the opening.

According to this configuration, a level difference can be more reliably formed between the edges of the opening so as to be parallel to the zipper.

In the above first aspect, one of a pair of the pedestal sections, the edge of which is further apart from a top section of the bag, is defined as a first pedestal section, and another pedestal section is defined as a second pedestal section, the first cut section is formed above the edge of the first pedestal section and below the edge of the second pedestal section, the second cut section is formed above the edge of the second pedestal section, and the first cut section is further formed above the second cut section.

According to this configuration, the first laminated film is formed with the two first cut sections above the edge of the first pedestal section. At a substantial center of a region where the two first cut sections are projected in the second laminated film, the second cut section is formed, and the edge of the second pedestal section is located.

According to this configuration, even when force is applied either in the upper direction or in the lower direction of the packaging bag at the time of unsealing of the packaging bag, the packaging bag is cut by any of the upper and lower first cut sections, and therefore a linear level difference can be reliably formed between the edges of the opening so as to be parallel to the zipper.

In the above first aspect, the zipper may be formed with an uneven shape on a side, close to the opening, of a pedestal section.

According to this configuration, a user of the packaging bag can more easily grasp the position of the zipper.

A method for manufacturing a packaging bag according to a second aspect of the present invention, the packaging bag being formed in a bag shape by overlapping of a first laminated film and a second laminated film facing each other, being unsealed by cutting of a predetermined section, and being provided with a zipper for opening and closing an opening along edges of the opening formed by the unsealing, the method comprising: a first step of forming a linear first cut section that becomes the edge of the opening by the unsealing, in a first film that becomes an intermediate layer or an outer layer; a second step of forming a linear second cut section that becomes the edge of the opening by the unsealing, at a different level from the first cut section, in a second film that becomes an intermediate layer or an outer layer; and a third step of overlapping the first film with a heat seal layer bonded thereto with the second film with a heat seal layer bonded thereto to be formed in a bag shape.

Advantageous Effects of Invention

The present invention has an excellent effect that a linear level difference can be formed between edges of an opening so as to be parallel to a zipper.

DESCRIPTION OF EMBODIMENTS

Hereinafter, a packaging bag and a method for manufacturing a packaging bag according to the present invention will be described with reference to the drawings.

First Embodiment

Hereinafter, a first embodiment of the packaging bag of the present invention will be described as an example.

Figure 1:
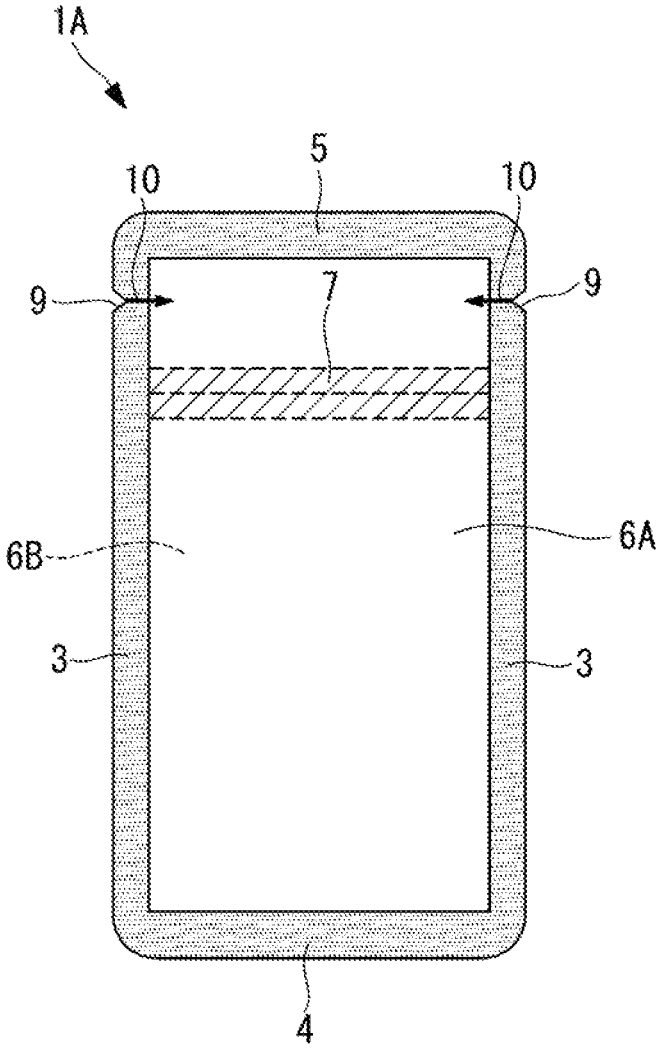
FIG. 1 is a schematic diagram of a packaging bag before unsealing according to a first embodiment of the present invention.
Figure 2:
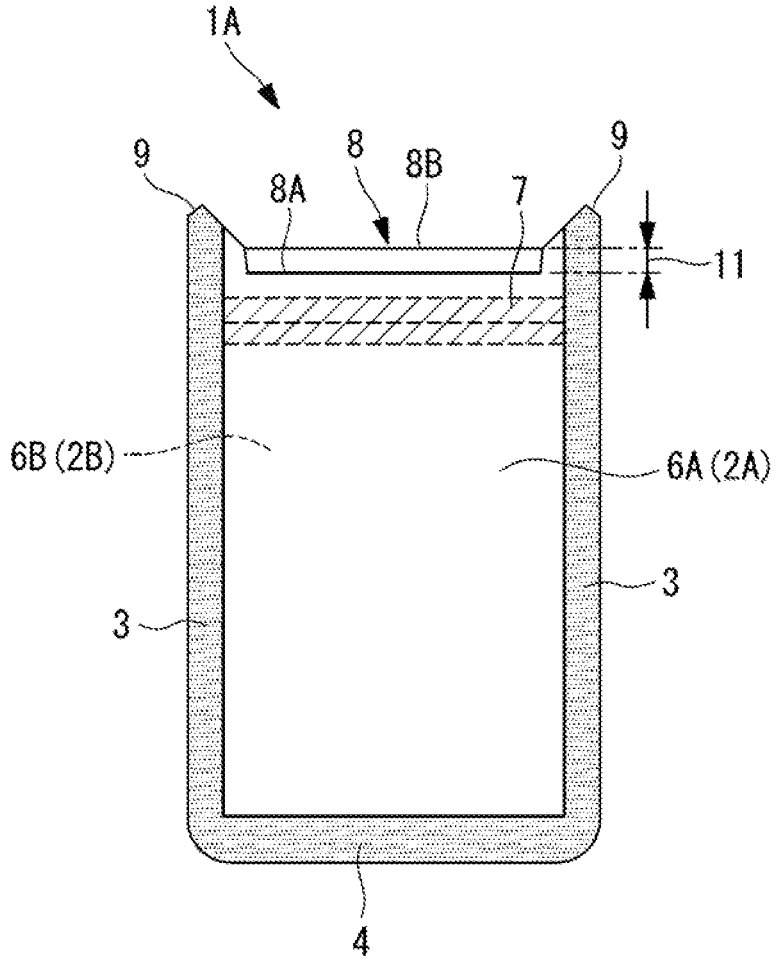
FIG. 2 is a schematic diagram of the packaging bag after unsealing according to the first embodiment of the present invention.
Figure 3:
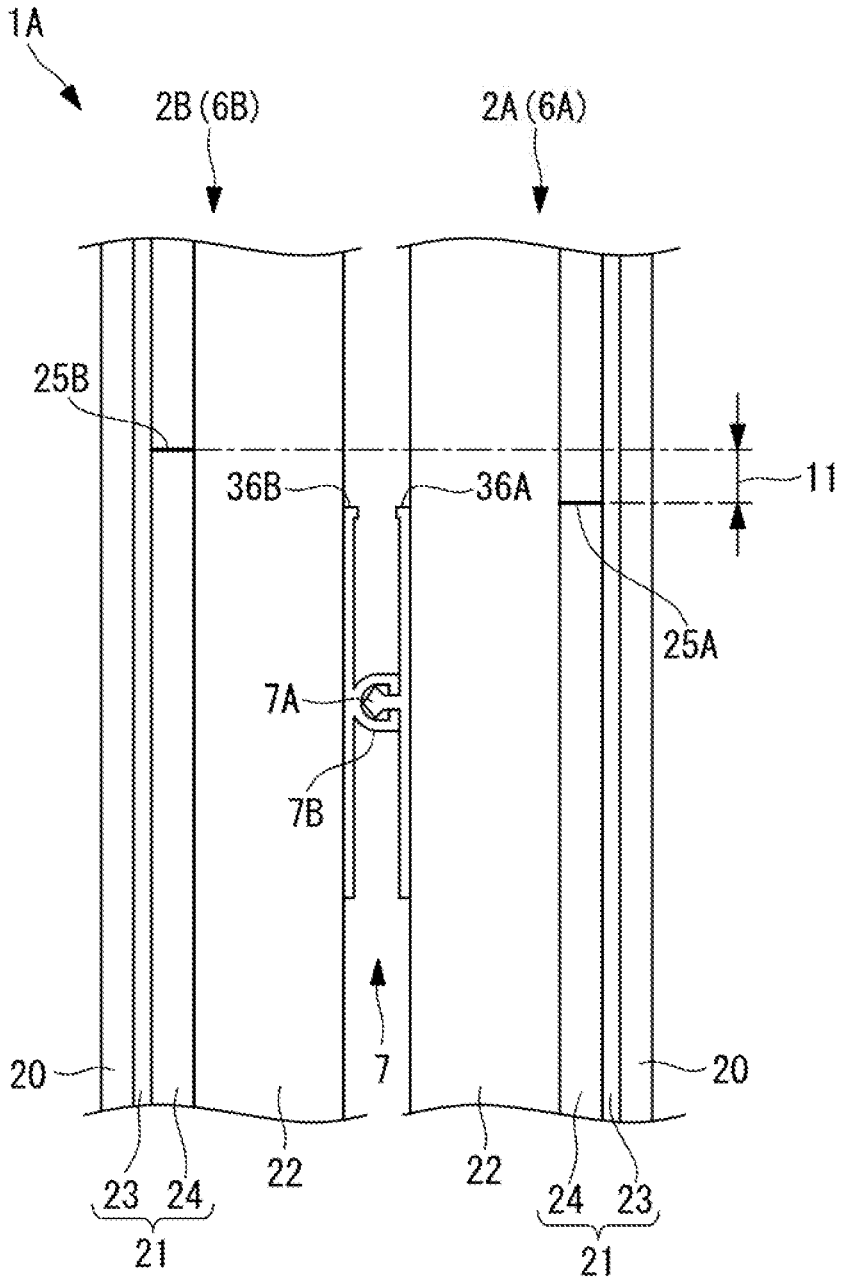
FIG. 3 is a partially enlarged longitudinal sectional view illustrating cut sections of the packaging bag according to the first embodiment of the present invention.

FIG. 1 is a schematic diagram of a packaging bag 1A before unsealing according to this embodiment, and FIG. 2 is a schematic diagram of the packaging bag 1A after unsealing. FIG. 3 is a longitudinal sectional view of the packaging bag 1A. In the following description, the upper side and the lower side mean the upper side and the lower side of the packaging bag 1A in FIG. 1, the horizontal direction means the crosswise direction of the packaging bag 1A, namely the direction perpendicular to the vertical direction.

As illustrated in FIG. 3, the packaging bag 1A is formed in a bag shape by overlapping of a pair of a laminated film 2A and a laminated film 2B, and a predetermined section (an upper section 5 and the vicinity thereof as an example) is cut by a user, so that the packaging bag 1A is unsealed.

As illustrated in FIG. 1, side sections 3 and lower sections 4 of the laminated films 2A, 2B are joined to each other such that the shape of the packaging bag 1A is formed in a rectangle. Consequently, the laminated film 2A becomes a front surface film 6A of the packaging bag 1A, and the laminated film 2B becomes a back surface film 6B of the packaging bag 1A. Then, the upper sections 5 of the packaging bag 1A are joined to be sealed, after a content is enclosed. The joining is performed by heat sealing in this embodiment. Additionally, in the packaging bag 1A, the side sections 3 and the upper sections 5 may be joined, and thereafter the lower sections 4 may be joined after a content is enclosed from the lower section 4.

Furthermore, the packaging bag 1A according to this embodiment includes a zipper 7 which is a reclosable means, on an inner surface. The zipper 7 is provided at a position along edges 8A, 8B of an opening 8 formed by unsealing, and has a pair of a male member 7A and a female member 7B that can mesh with each other in order to make the opening 8 openable and closeable, as an example.

Thus, the packaging bag 1A is a reclosable packaging bag in which the opening 8 can be resealed by the zipper 7 even when unsealed.

In the packaging bag 1A, notches 9 that become starting positions of unsealing are formed in the two side sections 3. In the packaging bag 1A, force is applied to regions where the notches 9 are formed, so that a section including the upper section 5 is cut to be unsealed. An indication line 10 for indicating the cut direction in unsealing is printed on the front surface film 6A or the back surface film 6B of the packaging bag 1A so as to correspond to the positions of the notches 9.

As illustrated in FIG. 2, in the packaging bag 1A according to this embodiment, cut sections 25A, 25B described below in detail are formed in the laminated films 2A, 2B such that a level difference 11 is generated between the edge 8A of the front surface film 6A and the edge 8B of the back surface film 6B, and the edges 8A, 8B become linear (horizontal). The level difference 11 between the edges 8A, 8B of the opening 8 may be, for example, in a range of 0.4 mm to 10 mm, and preferably 0.8 mm to 5 mm.

As illustrated in FIG. 3, the laminated films 2A, 2B forming the packaging bag 1A each are formed by lamination of a base layer 20, an intermediate layer 21, and a heat seal layer 22.

A film used in the base layer 20 that is an outer layer is preferably a film excellent in physical strength such as thrust toughness, tensile strength, and impact resistance, or excellent in printability. Examples of such a film include films formed of synthetic resin such as polyester, polyamide, polypropylene, polycarbonate, and polyacetal. These films may be unoriented films, or may be oriented films that are biaxially or uniaxially oriented. However, as the film used in the base layer 20, the oriented film that is biaxially or uniaxially oriented is preferably used in view of printability. Additionally, synthetic paper, cellophane, paper, non-woven fabric, or the like may be used as needed.

As the film used in the base layer 20, a barrier film to which a barrier function against oxygen, water vapor, and the like is imparted may be used. Examples of such a film include a vapor-deposited film provided with a vapor-deposited layer, and a coat film provided with a coat layer. More specifically, examples of the vapor-deposited layer include inorganic materials such as aluminum, magnesium, silicon oxide, aluminum oxide, indium oxide, tin oxide, zirconium oxide, and magnesium oxide. Additionally, examples of the coat film include the above uniaxially or biaxially oriented film coated with a barrier agent such as a crosslinking substance of modified polyvinyl alcohol and unsaturated carboxylic acid polyvalent metal salt, and polyvinylidene chloride.

The intermediate layer 21 is a layer including one or more layer and provided between the base layer 20 and heat seal layer 22. In this embodiment, the intermediate layer 21 is formed by a barrier layer 23 and a functional layer 24.

As the barrier layer 23, a film which is the same as a barrier film used in the base layer 20 can be used. In addition to the above film, metal foil such as aluminum foil may be used.

In a case where a barrier film having a barrier property is used in the base layer 20, the barrier layer 23 may not be included in the intermediate layer 21.

A function that the functional layer 24 should have is determined on the basis of a function required in response to a product contained in the packaging bag 1A. For example, mechanical toughness, bending resistance, thrust resistance, impact resistance, or the like is suitably selected, or a barrier property function that is the same as the barrier layer 23 may be selected.

As the functional layer 24 according to this embodiment, biaxially oriented nylon is used in order to impart physical strength (mechanical strength) such as thrust toughness, tensile strength, and impact resistance to the laminated films 2A, 2B. More specifically, examples of resin for a film used in the functional layer 24 include polyethylene terephthalate, polypropylene, polyamide, and ethylene-vinylalcohol copolymer, and a uniaxially oriented film or a biaxially oriented film formed of the above is preferable.

Examples of a film (sealant film) used in heat seal layer 22 include films formed of at least one resin selected from the group consisting of polyolefin resin such as polypropylene, and polyethylene such as low density polyethylene, medium density polyethylene, high density polyethylene, and linear low density polyethylene, mixed resin of these, ionomer resin, ethylene-vinyl acetate copolymer, ethylene-acrylic acid copolymer, ethylene-acrylic acid methyl copolymer, and ethylene-methacrylic acid copolymer.

The male member 7A forming the zipper 7 is joined to the heat seal layer 22 of the front surface film 6A, and the female member 7B forming the zipper 7 is joined to the heat seal layer 22 of the back surface film 6B.

In the packaging bag 1A according to this embodiment, the linear cut sections 25A, 25B that pass through the functional layers 24 and become the edges 8A, 8B of the opening 8 are formed in the respective functional layers 24 forming the intermediate layers 21 of the laminated film 2A and the laminated film 2B. These cut sections 25A, 25B are equivalent to a first cut section and a second cut section of the present invention, respectively. In other words, the cut sections 25A, 25B are sections to be opened which become the opening 8 by unsealing of the packaging bag 1A.

This cut section 25A is formed in the functional layer 24 of the laminated film 2A so as to be parallel to the zipper 7. Additionally, the cut section 25B is formed in parallel to the cut section 25A at different levels in the functional layer 24 of the laminated film 2B so as to be parallel to the zipper 7.

That is, the cut sections 25A, 25B are formed in the horizontal direction at substantially the same heights as the edges 36A, 36B on the upper side of the zipper 7 vertically, or on the upper side with respect to the edges 36A, 36B.

The cut sections 25A, 25B are continuous cuts, for example, are formed by laser processing, processing by a blade, or the like. Additionally, the cut sections 25A, 25B are formed so as to pass through the respective functional layers 24.

Thus, the cut sections 25A, 25B are previously formed in the functional layers 24, so that even when high strength is imparted to the functional layers 24 in order to increase the strength of the packaging bag 1A, the laminated films 2A, 2B of the packaging bag 1A are cut along the cut sections 25A, 25B, that is, cut so as to be parallel to the zipper 7, and the opening 8 is formed in the packaging bag 1A. Additionally, the cut sections 25A, 25B according to this embodiment are continuous cuts, and therefore the edges 8A, 8B of the opening 8 are more reliably formed linearly.

In other words, the cut sections 25A, 25B function as guiding lines or unsealing auxiliary lines in unsealing of the packaging bag 1A.

Furthermore, in the packaging bag 1A according to this embodiment, the cut sections 25A, 25B are previously formed in the functional layers 24 at different levels so as to be parallel to the zipper 7, and therefore the linear level difference 11 is formed between the edges 8A, 8B of the opening 8 so as to be parallel to the zipper 7.

Accordingly, a user of the packaging bag 1A according to this embodiment can easily open the opening 8, and easily confirm the position of the zipper 7, and therefore opening and closing by the zipper 7 is facilitated Now, a method for manufacturing the packaging bag 1A according to this embodiment will be described.

First step: A film material A that becomes the functional layer 24 of the laminated film 2A is reeled out from a film roll, and the cut section 25A is formed at predetermined intervals in the longitudinal direction of the film material A.

Second step: A film material B that becomes the functional layer 24 of the laminated film 2B is reeled out from a film roll, and the cut section 25B is formed at predetermined intervals in the longitudinal direction of the film material B at a different level from the cut section 25A.

In order to prevent the film materials A, B from being cut before bonded to other film materials, the cut sections 25A, 25B are provided with regions where cuts are intermittently not formed.

Third step: Each film material that becomes heat seal layer 22, the barrier layer 23, or the base layer 20 is bonded to the film material A formed with the cut section 25A while being fed by a roll, so that a laminated film material A that becomes the laminated film 2A is formed.

Fourth step: Each film material that becomes heat seal layer 22, the barrier layer 23, or the base layer 20 is bonded to the film material B formed with the cut section 25B while being fed by a roll, so that a laminated film material B that becomes the laminated film 2B is formed.

When the respective layers are bonded, the position of a picture (such as the indication line 10) printed on the base layer 20, and the positions of the cut sections 25A, 25B are previously adjusted so as to coincide with each other in a predetermined allowable range.

Thus, in the manufacturing method according to the present invention, the cut sections 25A, 25B are previously formed in the functional layers 24, and thereafter bonded to other layers, and therefore cuts are never formed in the other layers. Particularly, cuts are never formed in the barrier layers 23, and therefore barrier properties of the barrier layer 23 are not damaged by the formation of the cut sections 25A, 25B.

Fifth step: The zipper 7 is joined to the heat seal layers 22 of the laminated film material A and the laminated film material B. When the zipper 7 is bonded to the heat seal layers 22, the position of the zipper 7 and the positions of the cut sections 25A, 25B are previously adjusted so as to coincide with each other in a predetermined allowable range.

Sixth step: The laminated film material A and the laminated film material B facing each other overlap with each other while being fed by the rolls, and the side sections in the longitudinal direction of the laminated film materials are joined to each other by heat sealing.

Seventh step: The joined film materials are heat-sealed and cut in the short direction, and are formed with the notches 9 in the film materials, and thereafter are cut in the longitudinal direction at a plurality of portions, thereby forming the packaging bag 1A.

Now, the shape of the notch 9 according to this embodiment will be described with reference to FIG. 4 to FIG. 7.

Here, with conventional notches 9 (a hexagonal notch, a V-notch, a U-notch, an I-notch, and the like), an unsealing starting position can be determined by concentration of force on an end of the notch in unsealing of the packaging bag 1A, but the unseal direction is not determined. That is, depending on the direction of force applied to the notches 9, the packaging bag is not torn toward the directions of the cut sections 25A, 25B. As a result, there is a possibility that the packaging bag 1A is unsealed at portions different from the cut sections 25A, 25B.

As an example of the notch 9 according to this embodiment, the notch 9A that guides the tearing directions such that the laminated films 2A, 2B are torn in the extending directions of the cut sections 25A, 25B is preferably used. As illustrated in FIG. 4 to FIG. 7, in the notch 9A, one end 30A of a curved shape 30 and one end 31A of a V-shape 31 are continuously formed, and the cut section 25A or the cut section 25B is formed so as to be located in the tip direction of the V-shape 31.

This notch 9A is a notch having an action and a function of guiding the tearing direction.

More specifically, the V-shape 31 is formed by a second linear section 31-2 formed at an acute angle with respect to the first linear section 31-1, and inclines toward the cut sections 25A, 25B upward or downward. That is, the tip direction of the V-shape 31 (extending direction of a line 33 for dividing a tip 31B into two) is not parallel to the cut sections 25A, 25B but has an angle θ (for example, 20° to 80°, preferably 40° to 80°), and is formed so as to incline to the cut section 25A or the cut section 25B.

More precisely, the tip 31B of the V-shape 31 has a rounded arc shape, and is, for example, 5/100·R to 30/100·R.

Now, unsealing of the packaging bag 1A formed with the notch 9A will be described.

In order to unseal the packaging bag 1A, an unsealing person of the packaging bag 1A applies force to a portion where the notch 9A is formed. In this case, force is applied to the notch 9A in any of the upper direction 34A, the parallel direction 34B, and the lower direction 34C. However, even when the force is applied to the notch 9A in any direction, the force goes toward the direction of a line 34D along the curved shape 30, and is concentrated on the tip 31B of the V-shape 31 with the arc shape. Therefore, regardless of the direction of the force applied to the notch 9A, the force is concentrated in the tip direction of the V-shape 31, and the packaging bag is cut along the line 33 which is the tip direction.

In a case where the tip 31B located in the tip direction of the V-shape 31 is not sharp but, for example, has a blunt shape compared with a sharp shape such as the above arc shape, force for tearing is concentrated on the tip 31B, and tearing resistance slightly higher than the sharp shape exhibits when tearing of films is started. When tearing force exceeds this resistance, the directions of the force are matched toward the tip direction of the V-shape 31, and therefore it is considered that the tearing direction is the tip direction of the V-shape 31.

That is, the notch 9A is formed by the one end 30A of the curved shape 30 and the one end 31A of the V-shape 31 continued to the one end 30A of the curved shape 30, so that the directivity of cutting is imparted. The cut section 25A or the cut section 25B is provided in the tip direction of the V-shape 31, so that the packaging bag 1A can be unsealed along the cut sections 25A, 25B regardless of the direction of force applied to the notch 9A.

Figure 4:
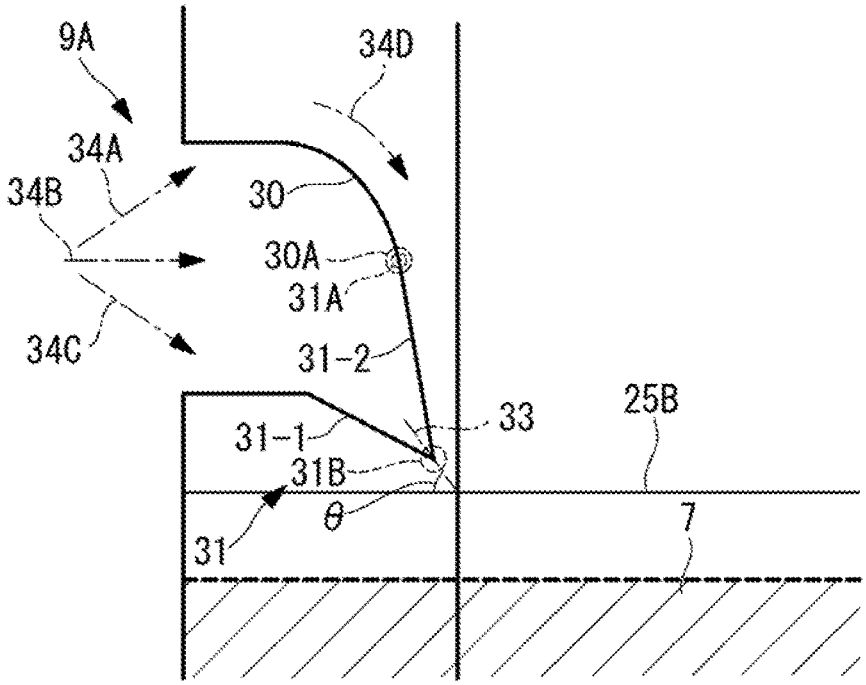
FIG. 4 is a partially enlarged external view illustrating a shape of a notch according to the first embodiment of the present invention.
Figure 5:
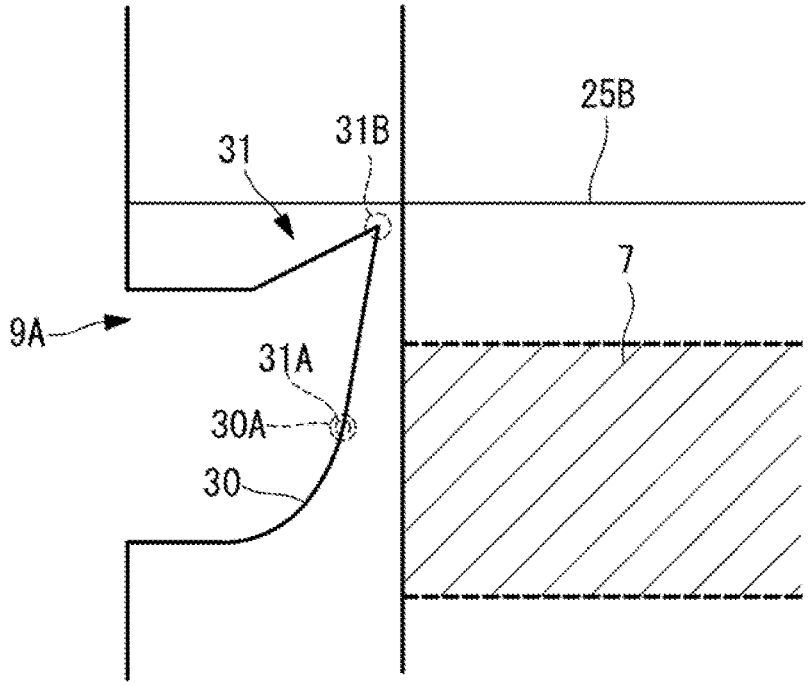
FIG. 5 is a partially enlarged external view illustrating a modification of the notch according to the first embodiment of the present invention.
Figure 6:
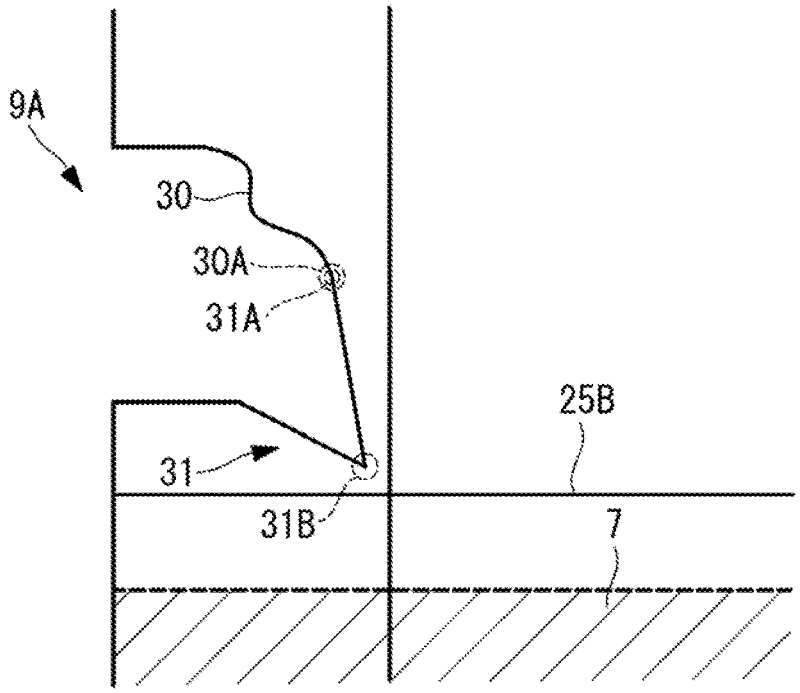
FIG. 6 is a partially enlarged external view illustrating a modification of the notch according to the first embodiment of the present invention.
Figure 7:
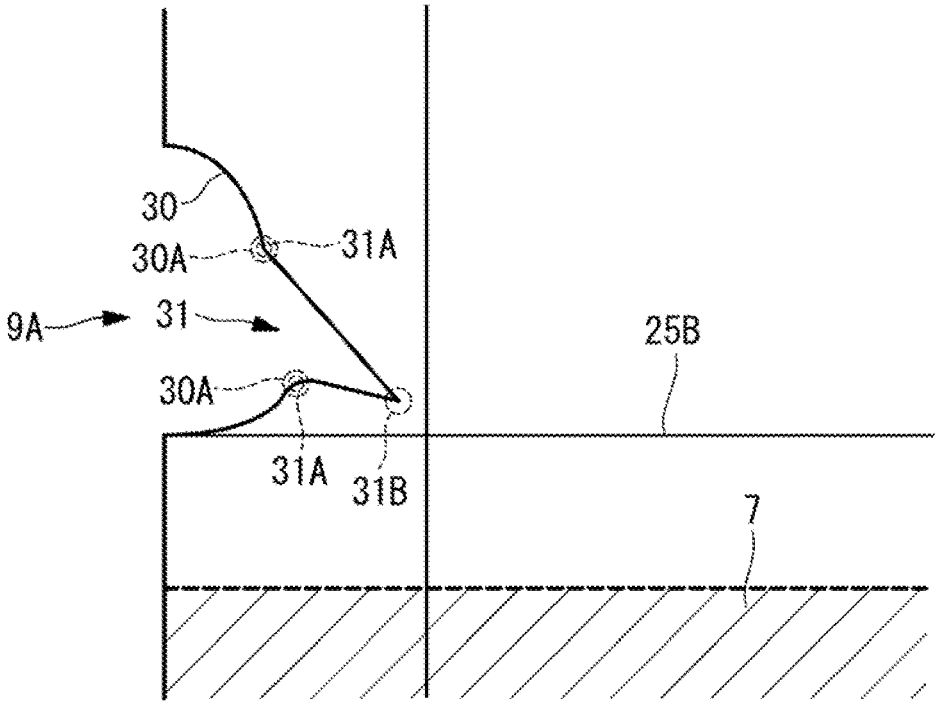
FIG. 7 is a partially enlarged external view illustrating a modification of the notch according to the first embodiment of the present invention.

In FIG. 4, as an example, an arc is formed as the curved shape 30, and the one end 30A of this arc and the one end 31A of the V-shape 31 are continued, so that the notch 9A is formed.

In the example in FIG. 4, the tip direction of the V-shape 31 is directed to the lower direction from the upper direction of the packaging bag 1A. On the other hand, as illustrated in the example in FIG. 5, the tip direction of the V-shape 31 is directed to the upper direction from the lower direction of the packaging bag 1A, and the cut section 25A or the cut section 25B may be located in this tip direction.

In the example in FIG. 4, the first linear section 31-1 is not parallel to the cut sections 25A, 25B. However, as long as the angle θ is formed such that the first linear section 31-1 inclines to the cut section 25A or the cut section 25B, the first linear section 31-1 may be parallel to the cut sections 25A, 25B.

The curved shape 30 may be formed by a plurality of arcs. In the example in FIG. 6, the curved shape 30 is formed in an S-shape. Furthermore, in the example in FIG. 7, two curved shapes 30 are formed with the V-shape 31 therebetween, and ends 30A of the two curved shapes 30 may be formed to be continued to ends 31A on both sides of the V-shape 31, respectively.

Figure 8:
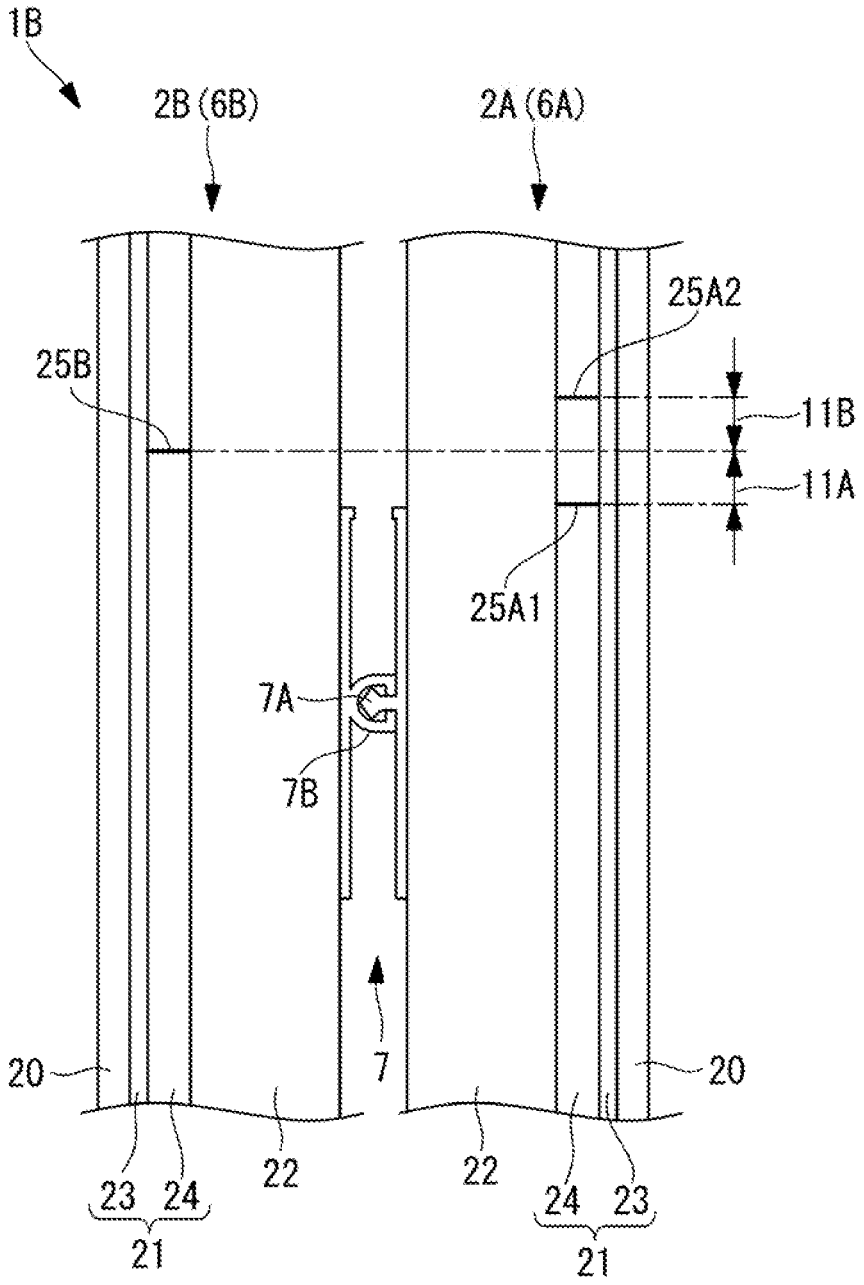
FIG. 8 is a partially enlarged longitudinal sectional view illustrating a modification of the cut sections according to the first embodiment of the present invention.

FIG. 8 is a modification of the packaging bag 1A according to this embodiment.

When the packaging bag 1A according to this embodiment is unsealed, depending on a situation whether or not a front surface film 6A of the packaging bag 1A faces an unsealing person, difference of a dominant hand of an unsealing person, or difference between a tearing way of pulling the upper section forward with respect to the notch and a tearing way of pushing the upper section from the near side toward the far side, the unsealing starting position is determined on the left or the right of the packaging bag 1A, and the direction of applied force is different. Therefore, depending on the direction of force applied in unsealing, force is sometimes applied to a position different from the cut section 25A or the cut section 25B, and the packaging bag 1A sometimes fails to be unsealed along the cut sections 25A, 25B.

A cut section 25A in a packaging bag 1B according to FIG. 8 includes a plurality (two in the example in FIG. 8) of cuts (cut sections 25A1, 25A2) which are formed spaced apart from each other so as to be parallel to each other with respect to the longitudinal direction of a zipper 7. A cut section 25B is formed at a substantial center of a region where the cut section 25A is projected in a laminated film 2B.

The cut sections 25A1, 25A2 are continuous cuts. Although it varies depending on the size of the packaging bag, for example, in a case of the bag with a vertical length of about 200 mm in FIG. 8, level differences 11A, 11B between the cut sections 25A1, 25A2 and the cut section 25B may be in a range of 0.2 mm to 5 mm, preferably in a range of 0.4 mm to 2.5 mm.

In the packaging bag 1B illustrated in FIG. 8, the cut section 25A1 or 25A2 in accordance with the direction of force applied in unsealing, among the cut sections 25A1, 25A2 formed at a plurality of portions, and the cut section 25B can form the linear level difference 11A or 11B between the edges 8A, 8B of the opening 8.

For example, in a case where unsealing is intended to be performed by applying force in the lower direction of the packaging bag 1B, the packaging bag 1B is unsealed along the cut section 25A1 in laminated film 2A forming the front surface film 6A. Then, when force is applied to the cut section 25A1, the force is necessarily applied also to the cut section 25B of the laminated film 2B forming a back surface film 6B, and therefore the packaging bag 1B is unsealed along the cut section 25B. On the other hand, in a case where unsealing is similarly intended to be performed by applying force in the upper direction of the packaging bag 1B, the packaging bag 1B is unsealed along the cut section 25B together with the cut section 25A2.

Thus, according to the packaging bag 1B, the linear level difference 11 can be formed between the edges 8A, 8B of the opening 8 so as to be parallel to the zipper 7, regardless of the direction of force in unsealing of the packaging bag 1B.

Figure 9:
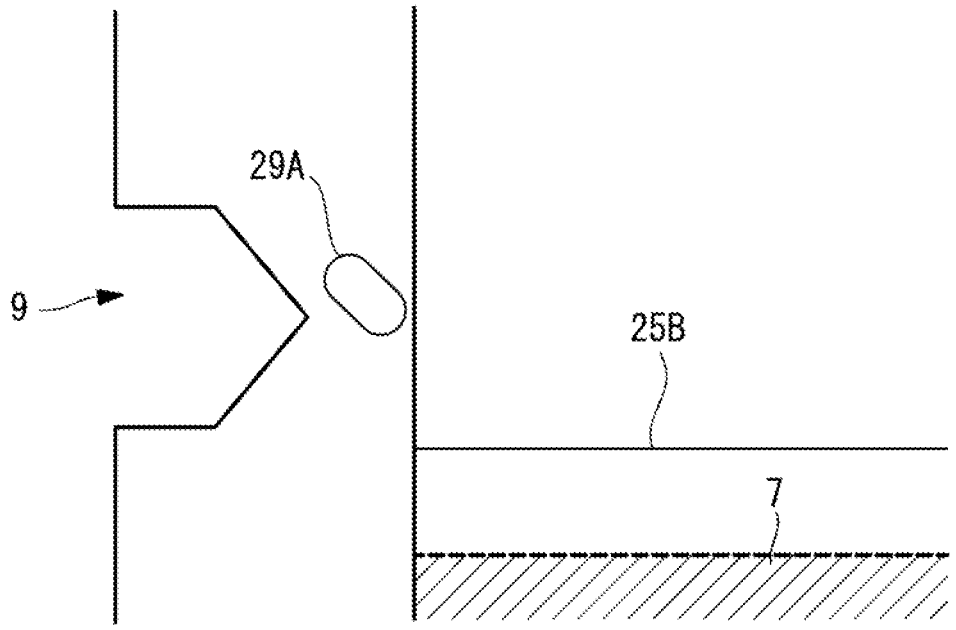
FIG. 9 is a partially enlarged schematic diagram illustrating a guide section provided in the vicinity of the notch of the first embodiment of the present invention.
Figure 10:
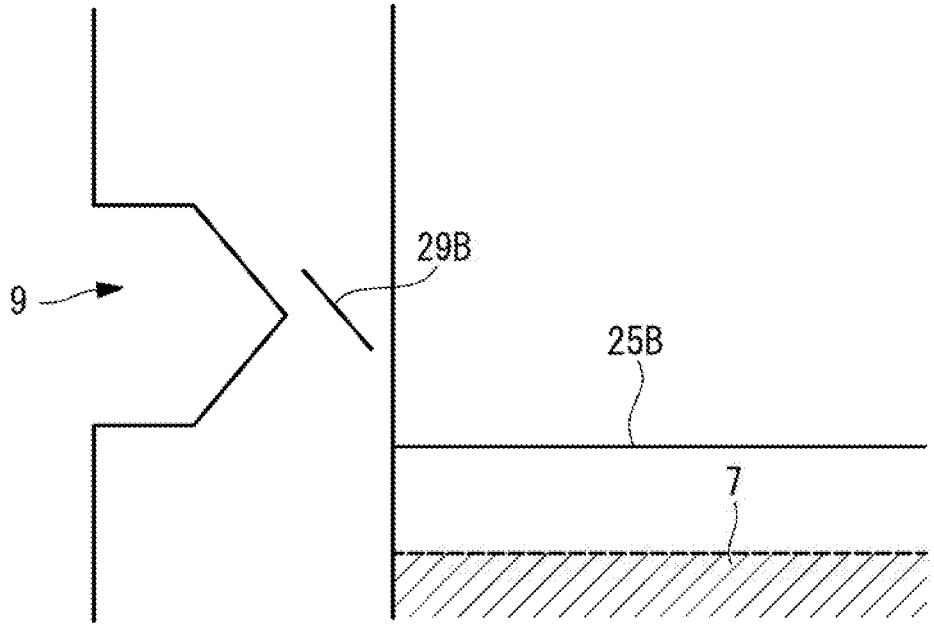
FIG. 10 is a partially enlarged schematic diagram illustrating a guide section provided in the vicinity of the notch of the first embodiment of the present invention.

FIGS. 9, 10 each illustrate a modification of a case where the packaging bag 1A is provided with a guide section 29 (guide sections 29A, 29B) for guiding the cut direction by the notch 9 to the cut section 25A or the cut section 25B. The notches 9 in FIGS. 9, 10 are examples of a hexagonal notch. The notches are not limited to this, but may be V-notches, I-notches, U-notches, or the above notches 9A for guiding the tearing direction.

The guide section 29 is provided in the vicinity of the notch 9, and is formed so as to incline to the cut section 25A or the cut section 25B. In other words, the cut section 25A or the cut section 25B is located ahead of the extending direction of the longitudinal direction of the guide section 29 so as to obliquely intersect.

The packaging bag 1A is provided with the guide section 29, so that cutting with the notch 9 as the starting position is performed along the guide section 29, and the cut direction is guided to the cut section 25A or the cut section 25B, and therefore the packaging bag 1A can be unsealed along the cut sections 25A, 25B regardless of the direction of force applied to the notch 9.

In the example in FIG. 9, the guide section 29A is formed in a rounded rectangle having an uneven shape with respect to the front surface film 6A or the back surface film 6B of the packaging bag 1A. More specifically, for example, a pressing die having the shape of the guide section 29A is pressed from a surface of the front surface film 6A or the back surface film 6B of the packaging bag 1A, so that the uneven shape is formed.

In the example in FIG. 10, the guide section 29B is formed as a cut in at least one of the laminated films 2A, 2B. More specifically, the guide section 29B is, for example, a continuous cut or a broken line (discontinuous) cut. This cut is formed by, for example, laser processing, processing by a blade, or the like. A layer where the guide section 29B is formed is not particularly limited, and the guide section 29B is provided in any one of or a plurality of the base layer 20, intermediate layer 21 (the barrier layer 23, the functional layer 24), and the heat seal layer 22.

Figure 11:
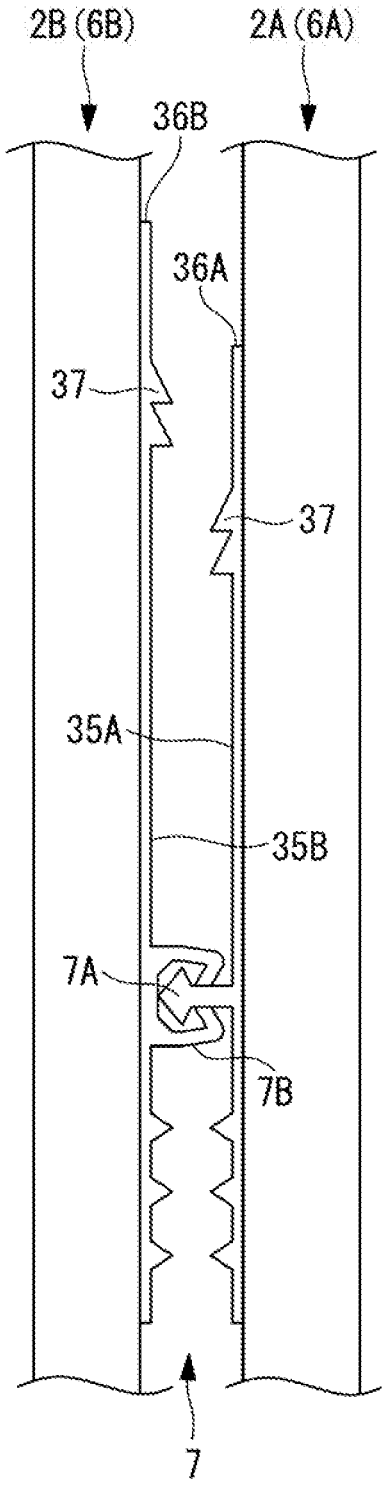
FIG. 11 is a partially enlarged longitudinal sectional view illustrating a modification of a zipper of the first embodiment of the present invention.

FIG. 11 is a longitudinal sectional view of a packaging bag 1A illustrating a modification of the zipper 7.

As illustrated in FIG. 11, in a zipper 7, edges 36A, 36B of a pair of pedestal sections 35A, 35B of the zipper 7 are at different levels in the direction of an opening 8. More specifically, the lengths in the upper direction from meshing sections of a male member 7A and a female member 7B in the width direction (vertical direction) of the pedestal section 35A of the male member 7A and the pedestal section 35B of the female member 7B are different, and the edges 36A, 36B of the pedestal sections 35A, 35B are located at different levels on the opening 8 side. The edges 36A, 36B of the pedestal sections 35A, 35B preferably coincide with the cut sections 25A, 25B, or are preferably located in the vicinities of the cut sections 25A, 25B.

Consequently, the packaging bag 1A is unsealed along the edges 36A, 36B of the pedestal sections 35A, 35B, and therefore a linear level difference 11 can be more reliably formed between edges 8A, 8B of the opening 8 so as to be parallel to the zipper 7.

The zipper 7 is formed with ribs 37 that have uneven shapes on sides, close to the opening 8, of the pedestal sections 35A, 35B. A user of the packaging bag 1A touches the ribs 37 with his/her fingers when the opening 8 is opened and closed, so that he/she can recognize the position of the zipper 7 by the sense of touch. Therefore, the user can easily grasp the position of the zipper 7. As a result, opening and closing by using the zipper 7 is facilitated.

As described above, the packaging bag 1A according to this embodiment is formed in a bag shape by overlapping of the laminated film 2A and the laminated film 2B facing each other, and the predetermined section is cut, so that the packaging bag 1A is unsealed. The packaging bag 1A includes the zipper 7 for opening and closing the opening 8, the zipper 7 being provided along the edges 8A, 8B of the opening 8 formed by unsealing, the cut section 25A that is formed in the functional layer 24 of the intermediate layer 21 of the laminated film 2A so as to be parallel to the zipper 7, and is a section to be opened, and the cut section 25B that is formed at a different level from the cut section 25A in the functional layer 24 of the intermediate layer 21 of the laminated film 2B so as to be parallel to the zipper 7.

Thus, in the packaging bag 1A, the cut sections 25A, 25B are previously formed at different levels in the intermediate layers 21 so as to be parallel to the zipper 7, and therefore the linear level difference 11 can be formed between the edges 8A, 8B of the opening 8 so as to be parallel to the zipper 7.

The packaging bag 1A according to this embodiment is formed by the laminated films 2A, 2B each having the base layer 20, the barrier layer 23 and the functional layer 24 that are the intermediate layer 21, and the heat seal layer 22. However, the packaging bag 1A is not limited to this, and each of the laminated films 2A, 2B may be formed by lamination of at least two layers, namely the functional layer 24 and heat seal layer 22.

The cut sections 25A, 25B and the cut sections 25A1, 25A2 according to this embodiment are continuous cuts, but are not limited to the above. The cut sections 25A, 25B, and the cut sections 25A1, 25A2 may be broken lines (discontinuous cuts, also called perforations), or belt-like narrow rough surfaces.

Second Embodiment

Hereinafter, a second embodiment of the present invention will be described as an example.

Figure 12:
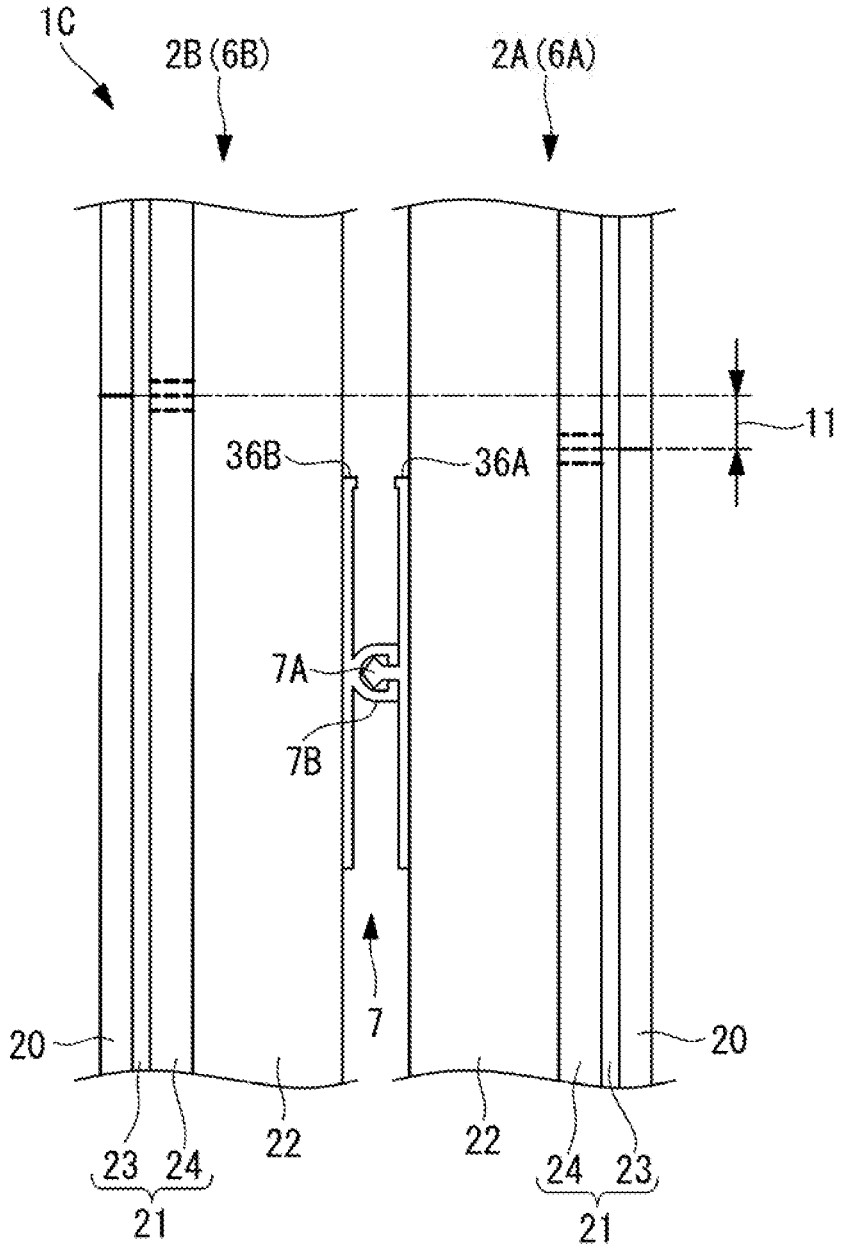
FIG. 12 is a partially enlarged longitudinal sectional view illustrating cut sections of a packaging bag of a second embodiment of the present invention.

FIG. 12 is a partially enlarged longitudinal sectional view illustrating cut sections 25A, 25B of a packaging bag 1C of this embodiment. Components in FIG. 12 identical with the components in FIG. 3 are denoted by the same reference numerals, and description thereof will be omitted.

As illustrated in FIG. 12, in the packaging bag 1C according to this embodiment, four layers including a base layer 20 are formed similarly to the packaging bag 1A according to the first embodiment.

A plurality of cut sections 25A and a plurality of cut sections 25B are each formed spaced apart from each other in a functional layer 24 so as to be parallel to a zipper 7.

Furthermore, a cut section 25C is formed in the base layer 20 of a laminated film 2A so as to overlap with the cut section 25A, and a cut section 25D is formed in the base layer 20 that is an outer layer of a laminated film 2B so as to overlap with the cut section 25B. These cut sections 25C, 25D are equivalent to a third cut section and a fourth cut section of the present invention, respectively.

The packaging bag 1C is unsealed by the cut sections 25C, 25D formed in the base layer 20. However, in a case where the strength of the functional layers 24 is high, there is a possibility that the functional layers 24 become resistance to cutting, and the force applying direction is changed. Therefore, in order to more reliably linearly cut the functional layers 24, pluralities of the cut sections 25A, 25B are formed.

Thus, in the packaging bag 1C, the pluralities of cut sections 25A, 25B are formed, and therefore the packaging bag 1C is cut by the cut sections 25A, 25B in accordance with the force applying direction. Accordingly, in the packaging bag 1C, even when the laminated films 2A, 2B are each formed by three or more layers, a linear level difference 11 can be more reliably formed between edges 8A, 8B of an opening 8 so as to be parallel to the zipper 7.

The plurality of cut sections 25A, 25B, 25C, 25D may be continuous cuts, broken discontinuous cuts (perforations), or belt-like narrow rough surfaces. In the packaging bag 1C according to this embodiment, as an example, the pluralities of cut sections 25A, 25B are perforations, the cut sections 25C, 25D are continuous cuts.

A method for forming the cut sections 25A, 25B are similar to the method for manufacturing the packaging bag 1A described in the first embodiment.

On the other hand, the cut sections 25C, 25D are, for example, previously formed in a film which becomes the base layer 20 before the film which becomes the base layer 20 is bonded to other film. The cut sections 25C, 25D may be formed after all layers are bonded. However, in this case, the depths of the cuts are adjusted so as not to reach barrier layers 23.

In the example in FIG. 12, the cut sections 25A, 25B are each three, and the cut sections 25C, 25D are each located at a substantial center. However, the cut sections are not limited to this. The cut sections 25A, 25B each may be two or four or more, and the cut sections 25C, 25D may be located at positions deviating from the respective centers of the pluralities of the cut sections 25A, 25B.

Figure 13:
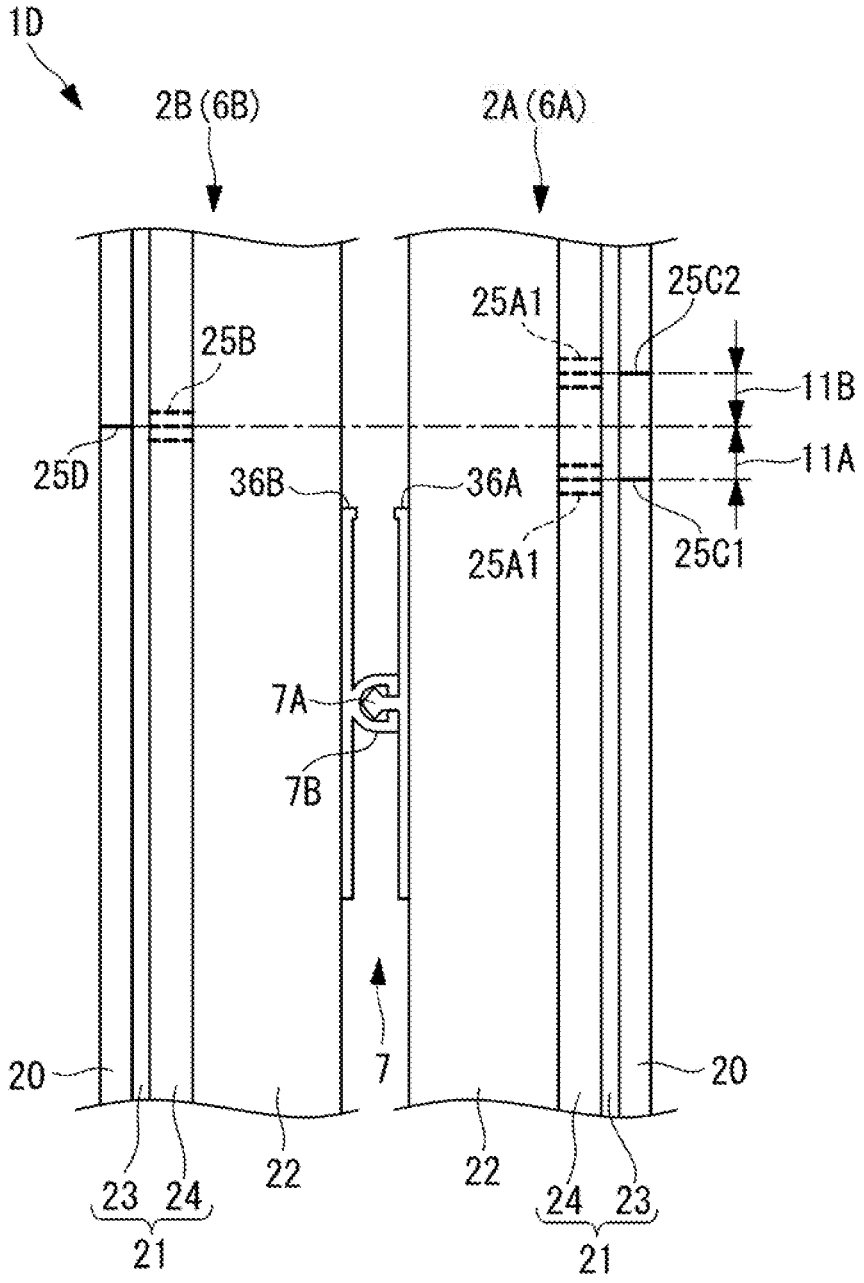
FIG. 13 is a partially enlarged longitudinal sectional view illustrating a modification of the cut sections according to the second embodiment of the present invention.

FIG. 13 is a modification of the packaging bag 1C according to this embodiment.

A cut section 25C in a packaging bag 1D according to FIG. 13 includes a plurality of (two in the example in FIG. 8) cuts (cut sections 25C1, 25C2) formed spaced apart from each other in parallel to the zipper 7. Additionally, a cut section 25D is formed at a center of a region where the cut section 25C is projected in a laminated film 2B.

Thus, in the packaging bag 1D, a linear level difference 11 is formed between edges 8A, 8B of an opening 8 by the cut section 25C in accordance with the force applying direction in unsealing, among the cut section 25C formed as a plurality of portions, and the cut section 25D.

Accordingly, in the packaging bag 1D, the linear level difference 11 can be formed between the edges 8A, 8B of the opening 8 so as to be parallel to the zipper 7, regardless of the direction of force in unsealing.

The cut sections 25C1, 25C2 are continuous cuts as an example, but are not limited to the above. The cut sections 25C1, 25C2 may be broken lines (discontinuous cuts, also called perforations), or belt-like narrow rough surfaces.

Third Embodiment

Hereinafter, a third embodiment of the present invention will be described as an example.

Figure 14:
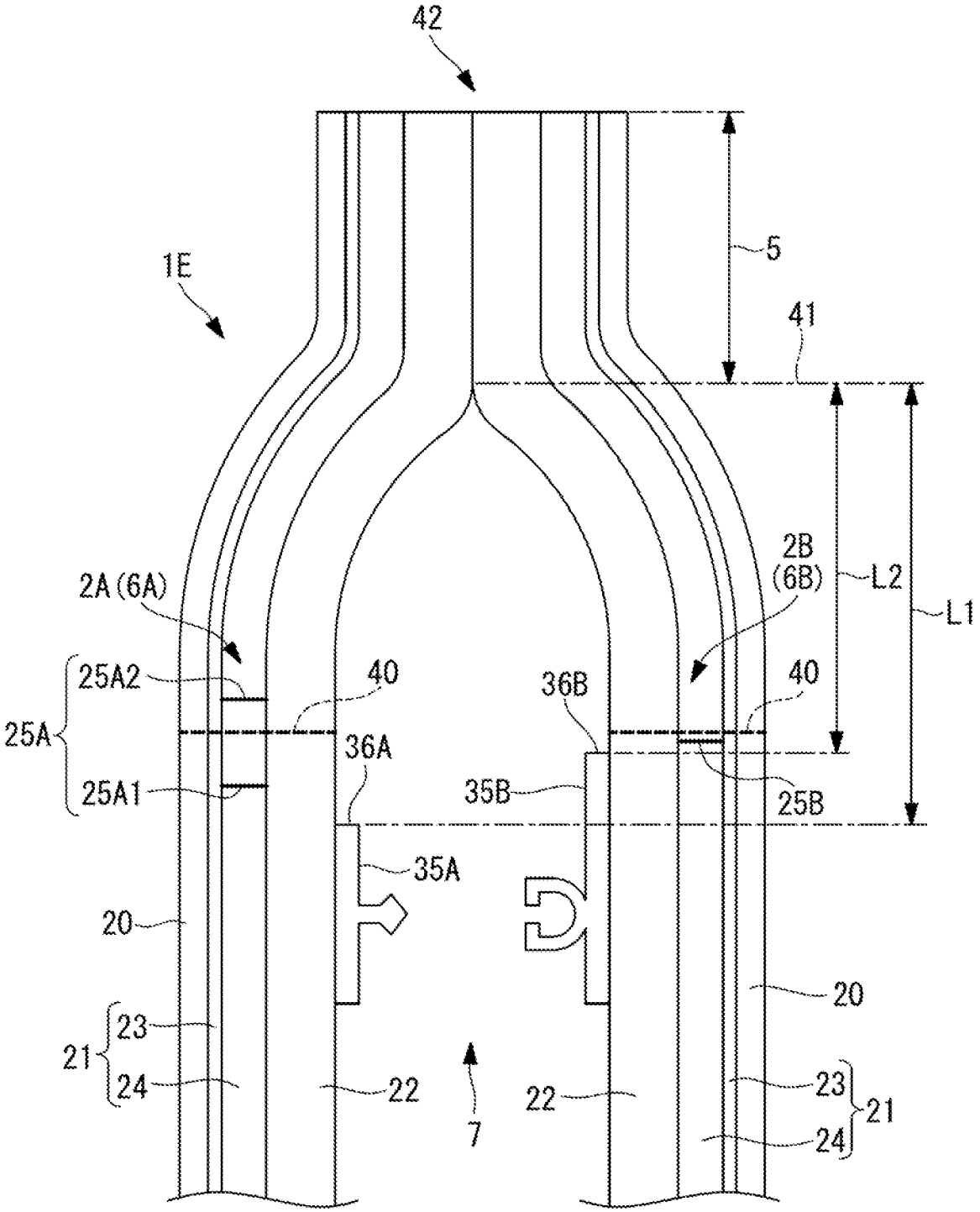
FIG. 14 is a partially enlarged longitudinal sectional view illustrating cut sections and edges of a zipper of a packaging bag according to a third embodiment of the present invention.

FIG. 14 is a partially enlarged longitudinal sectional view illustrating cut sections 25A, 25B and edges 36A, 36B of a zipper 7 of a packaging bag 1E according to this embodiment. In other words, FIG. 14 illustrates the positional relation between the cut sections 25A, 25B and the edges 36A, 36B of the zipper 7.

In the zipper 7, the edges 36A, 36B of a pair of pedestal sections 35A, 35B are at different levels in the direction of a section that becomes an opening 8. One of the pair of pedestal sections 35, the edge 36 of which is further apart from a top section 42 of the packaging bag 1E, is defined as the pedestal section 35A (first pedestal section), and the other is defined as the pedestal section 35B (second pedestal section). In other words, distances L1, L2 of the edge 36A of the pedestal section 35A and the edge 36B of the pedestal section 35B from a joining section inner edge 41 (lower end of an upper section 5) of the packaging bag 1E are different.

In the packaging bag 1E, a cut section 25A1 is formed above the edge 36A of the pedestal section 35A and below the edge 36B of the pedestal section 35B, as a first cut section which is the first, and the cut section 25B is formed above the edge 36B of the pedestal section 35B, as a second cut section. A cut section 25A2 is further formed above the cut section 25B, as a first cut section which is the second.

In other words, in a laminated film 2A (front surface film 6A), the two cut sections 25A1, 25A2 are formed above the edge 36A of the pedestal section 35A. In a region where the two cut sections 25A1, 25A2 are projected in a laminated film 2B (back surface film 6B), the cut section 25B is formed, and the edge 36B of the pedestal section 35B is located.

In this embodiment, a notch 9 is provided as an unsealing start section similarly to other embodiments. In FIG. 14, a tip position 40 of the notch 9 is preferably located between the two cut sections 25A1, 25A2 above the cut section 25B.

With such a configuration, when the packaging bag 1E is unsealed, force is applied to a region where the notch 9 is formed, so that the laminated film 2B is torn along the cut section 25B. On the other hand, the laminated film 2A is torn along the cut section 25A1 when force is applied in the lower direction, and the laminated film 2A is torn along the cut section 25A2 when force is applied in the upper direction.

As described above, even when force is applied either in the upper direction or in the lower direction of the packaging bag 1E in unsealing of the packaging bag 1E, the packaging bag 1E is cut by any of the upper and lower cut sections 25A1, 25A2, and therefore a linear level difference can be reliably formed between the edges 8A, 8B of the opening 8 so as to be parallel to the zipper 7.

When the packaging bag 1E is unsealed, the laminated film 2A or the laminated film 2B may be torn on the lower side beyond the cut section 25A1 or the cut section 25B. Even in such a case, when a tearing tip reaches the edges 36A, 36B of the zipper 7, the thicknesses of the laminated film 2A and the laminated film 2B are actually increased by the thickness amounts of the pedestal sections 35A, 35B of the zipper 7, and therefore tearing resistance become high, the tearing is guided such that the direction, in which the tearing advances, coincides with the length direction of the zipper 7. Consequently, the laminated films 2A, 2B are finally torn along the edges 36A, 36B of the zipper 7, and the opening 8 of the packaging bag 1E is formed with the linear level difference along the edges 36A, 36B of the zipper 7.

In the packaging bag 1E of this embodiment, the distances of the cut sections 25A, 25B, and the edges 36A, 36B of the pedestal sections 35A, 35B of the zipper 7 from the joining section inner edge 41 of the packaging bag 1E have specific positional relations, so that the linear level difference can be more reliably formed between the edges of the opening 8.

The notch 9 of the packaging bag 1E may be a notch 9A for guiding the tearing direction, and the tip direction of the notch 9A may be directed to the cut section 25B.

Consequently, the laminated film 2B is more reliably torn along the cut section 25B regardless of the direction of force applied to the notch 9A. With this, the laminated film 2A is more reliably torn along the lower cut section 25A1, so that the packaging bag 1E is unsealed, and the opening 8 is formed with the linear level difference.

Additionally, the packaging bag 1E is unsealed along the cut section 25A1 and the cut section 25B, so that the edge 8B of the opening 8 originated from the cut section 25B formed in the laminated film 2B (back surface film 6B) protrudes to the outside with respect to the edge 8A of the opening 8 formed in the laminated film 2A (front surface film 6A).

Here, in the packaging bag 1E according to this embodiment, the pedestal section 35B of the zipper 7 extends up to a position near the edge 8B of the opening 8, and therefore the thickness of the laminated film 2B is actually increased by the pedestal section 35B. The thickness of the pedestal section 35B is equal to or larger than the thickness of the back surface film 6B. Accordingly, in a case where the packaging bag 1E is unsealed again, a user easily grips the edge 8B formed by overlapping of the pedestal section 35B and the back surface film 6B, and having higher rigidity compared with a case of the back surface film only, and it becomes easy to unseal the packaging bag 1E again.

Figure 15:
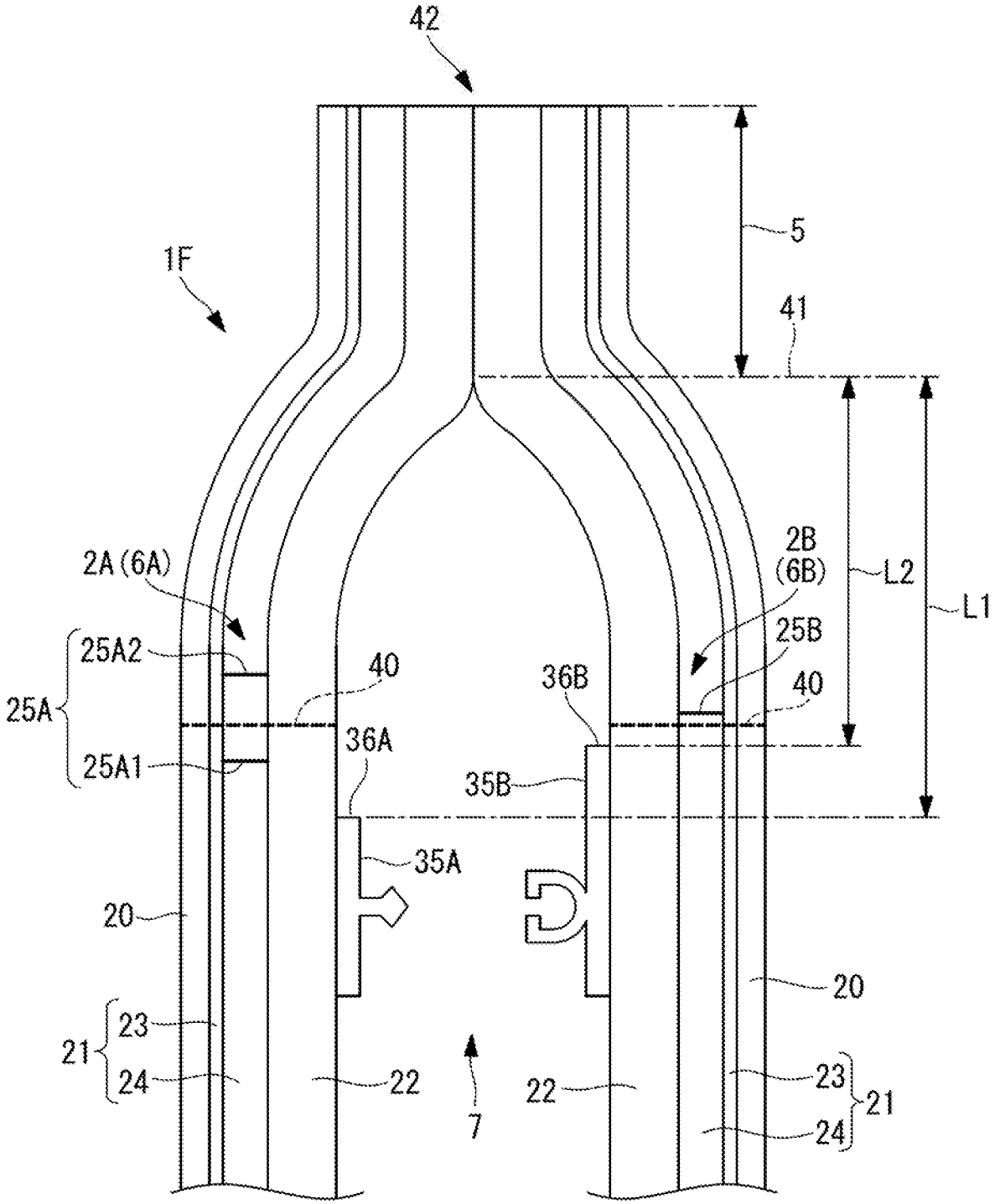
FIG. 15 is a partially enlarged longitudinal sectional view illustrating a modification of the cut sections and the edges of the zipper according to the third embodiment of the present invention.

FIG. 15 is a modification of the packaging bag 1E according to this embodiment.

In a packaging bag 1F according to FIG. 15, a tip position 40 of a notch 9 is located between two cut sections 25A1, 25A2 below a cut section 25B.

With such a configuration, similarly to the packaging bag 1E, even when force is applied either in the upper direction or in the lower direction of the packaging bag 1F at the time of unsealing of the packaging bag 1F, the packaging bag 1F is cut by any of the upper and lower cut sections 25A1, 25A2, and therefore a linear level difference can be reliably formed between edges 8A, 8B of an opening 8 so as to be parallel to a zipper 7.

As described above, although the present invention is described with reference to the above respective embodiments, the technical scope of the present invention is not limited to the scope described in the above embodiments.

Various changes or modifications can be added to the above respective embodiments without departing from the scope of the invention, and modes including the changes or the modifications are included the technical scope of the present invention. The above respective embodiments may be suitably combined. For example, the notches 9A may be formed in the packaging bags 1C, 1D according to the second embodiment, or the guide section 29A or the guide section 29B illustrated in FIGS. 9, 10 may be provided in the packaging bags 1C, 1D. Additionally, the zipper 7 illustrated in FIG. 11 may be provided in the packaging bags 1C, 1D.

In the above respective embodiments, the specific notch 9A for guiding the tearing direction, and the cut sections 25A, 25B are combined, but the present invention is not limited to this.

The shapes of the packaging bags 1A, 1B, 1C, 1D, 1E, 1F are not particularly limited, and each may be a three-sided bag, a four-sided bag, a gusset bag, or a standing bag.

In place of the cut sections 25A, 25B formed in the intermediate layers 21 of the packaging bag 1A, 1B, 1E, 1F, the cut sections 25A, 25B may be formed in the base layers 20 that are outer layers. Furthermore, the cut sections 25A, 25B may be formed in the intermediate layers 21 and the base layers 20 of the packaging bag 1A, 1B, 1E, 1F.

Furthermore, the cut sections 25A, 25B may be formed in heat seal layers that are inner layers in addition to the intermediate layers or the outer layers, when all layers are not provided at the same time. More specifically, the cut sections 25A, 25B can be formed in the base layers and heat seal layers, and the intermediate layers and the heat seal layers. In a case where the intermediate layers are each formed by a plurality of layers, the cut sections 25A, 25B each may be formed in only one or some layers among the plurality of layers forming the intermediate layer.

REFERENCE SIGNS LIST

1A, 1B, 1C, 1D, 1E, 1F packaging bag
2A laminated film
2B laminated film
7 zipper
8 opening
9A notch
20 base layer
21 intermediate layer
24 functional layer
25A cut section
25B cut section
29A, 29B guide section
42 top section

The invention claimed is:

1. A packaging bag formed in a bag shape by overlapping of a first laminated film and a second laminated film facing each other, and unsealed by cutting of a predetermined section, the packaging bag comprising:

a zipper for opening and closing an opening, the zipper being provided along first and second edges of the opening formed by the unsealing;

a linear first cut section that is formed in an intermediate layer of the first laminated film so as to be parallel to the zipper, and becomes the first edge of the opening by the unsealing; and a linear second cut section that is formed at a different level from the linear first cut section in an intermediate layer of the second laminated film so as to be parallel to the zipper, and becomes the second edge of the opening by the unsealing, wherein the linear first cut section includes a plurality of cuts and the linear second cut section includes a plurality of cuts, and wherein the plurality of cuts of the linear first cut section and the plurality of cuts of the linear second cut sections are each formed spaced from each other so as to be parallel to the zipper, a third cut section is formed in an outer layer of the first laminated film so as to overlap with the linear first cut section, and a fourth cut section is formed in an outer layer of the second laminated film so as to overlap with the linear second cut section.

2. The packaging bag according to claim 1, wherein the plurality of cuts of the linear first cut section and the linear second cut section are continuous cuts.

3. The packaging bag according to claim 1 or 2, the linear second cut section is formed at a center of a region where the linear first cut section is projected in the second laminated film.

4. The packaging bag according to claim 1, wherein the third cut section includes a plurality of cuts formed spaced from each other so as to be parallel to the zipper, and the fourth cut section is formed at a center of a region where the third cut section is projected in the second laminated film.

5. The packaging bag according to claim 1, comprising a notch that serves as a starting position of the unsealing, wherein the notch is formed by one end of a curved shape and one end of a V-shape continued to the one end of the curved shape, and the linear first cut section or the linear second cut section is provided in a tip direction of the V-shape.

6. The packaging bag according to claim 1, comprising:

a notch that serves as a starting position of the unsealing; and a guide section for guiding a direction of cutting by the notch to the linear first cut section or the linear second cut section.

7. The packaging bag according to claim 1, wherein the zipper further comprises a pair of pedestal sections, wherein the pair of pedestal sections includes a first pedestal section and a second pedestal section, wherein an edges of the first pedestal section is at a different level in a direction of the opening than an edge of the second pedestal section.

8. The packaging bag according to claim 7, wherein the edge of the first pedestal section is further apart from a top section of the bag than the edge of the second pedestal section, the linear first cut section is formed above the edge of the first pedestal section and below the edge of the second pedestal section, the linear second cut section is formed above the edge of the second pedestal section, and the linear first cut section is further formed above the linear second cut section.

9. The packaging bag according to claim 1, wherein the zipper is formed with an uneven shape on a side, close to the opening, of a pedestal section.

10. A method for manufacturing a packaging bag, the packaging bag being formed in a bag shape by overlapping of a first laminated film and a second laminated film facing each other, being unsealed by cutting of a predetermined section, and being provided with a zipper for opening and closing an opening, the zipper being provided along first and second edges of the opening formed by the unsealing, the method comprising:

forming a linear first cut section that becomes the first edge of the opening by the unsealing, in an intermediate layer of the first laminated film so as to be parallel to the zipper, wherein the linear first cut section includes a plurality of cuts;

forming a linear second cut section that becomes the second edge of the opening by the unsealing, at a different level from the linear first cut section, in an intermediate layer of the second laminated film so as to be parallel to the zipper; wherein the linear second cut section includes a plurality of cuts, wherein the plurality of cuts of the linear first cut section and the plurality of cuts of the linear second cut sections are each formed spaced from each other so as to be parallel to the zipper;

forming a third cut section in an outer layer of the first laminated film so as to overlap with the linear first cut section;

forming a fourth cut section in an outer layer of the second laminated film so as to overlap with the linear second cut section; and overlapping the first laminated film with a heat seal layer bonded thereto with the second laminated film with a heat seal layer bonded thereto to be formed in the bag shape.

* * * * *